US006478088B1

(12) United States Patent
Hansen et al.

(10) Patent No.: US 6,478,088 B1
(45) Date of Patent: Nov. 12, 2002

(54) METHOD FOR THE FORMATION OF A PLUG IN A PETROLEUM WELL

(75) Inventors: Henning Hansen, Randaberg (NO); Svein Henning Sølversen, Randaberg (NO)

(73) Assignee: Norse Cutting & Abandonment A/S, Tananger (NO)

( * ) Notice: Subject to any disclaimer, the term of this patent is extended or adjusted under 35 U.S.C. 154(b) by 0 days.

(21) Appl. No.: 09/674,684

(22) PCT Filed: May 4, 2000

(86) PCT No.: PCT/NO99/00147

§ 371 (c)(1),
(2), (4) Date: Jan. 31, 2001

(87) PCT Pub. No.: WO99/57409

PCT Pub. Date: Nov. 11, 1999

(30) Foreign Application Priority Data

May 4, 1998 (NO) ..... 19981998

(51) Int. Cl.[7] ..... E21B 33/00

(52) U.S. Cl. ..... 166/285; 166/295; 166/297; 166/298; 166/387; 166/55.8; 166/192; 166/242.2

(58) Field of Search ..... 166/285, 292, 166/294, 295, 297, 298, 386, 387, 55, 55.8, 192, 242.2

(56) References Cited

U.S. PATENT DOCUMENTS

| | | | | |
|---|---|---|---|---|
| 1,358,818 | A | | 11/1920 | Bering |
| 2,304,330 | A | | 12/1942 | Bannister |
| 3,280,913 | A | | 10/1966 | Smith |
| 3,933,204 | A | | 1/1976 | Knapp |
| 4,339,000 | A | | 7/1982 | Cronmiller |
| 4,389,765 | A | | 6/1983 | Thompson, Jr. |
| 4,688,640 | A | | 8/1987 | Pritchard, Jr. |
| 4,730,675 | A | | 3/1988 | Wygant et al. |
| 4,898,242 | A | | 2/1990 | Jennings, Jr. |
| 5,462,120 | A | * | 10/1995 | Gondouin |
| 5,472,052 | A | | 12/1995 | Head |
| 5,507,345 | A | * | 4/1996 | Wehunt et al. |
| 6,177,484 | B1 | * | 1/2001 | Surles |

FOREIGN PATENT DOCUMENTS

| | | |
|---|---|---|
| EP | 0136920 | 4/1985 |
| GB | 2211446 | 7/1989 |
| GB | 2275282 | 8/1994 |
| GB | 2305683 | 4/1997 |

* cited by examiner

*Primary Examiner*—Roger Schoeppel
(74) *Attorney, Agent, or Firm*—Dykema Gossett PLLC

(57) ABSTRACT

The invention relates to a method for the formation of a plug (1) in a petroleum well (2) extending from the earth's surface or the sea floor to a petroleum reservoir, which well is lined with casing (3, 3'). At least one opening (4) is formed in the casing (3) at a distance from the earth's surface, and a liquid curable resin is provided in at least a portion of the opening (4) and an adjacent area of the well (2), whereby the resin after curing forms a plug (1) in the well. The invention also relates to a tool (9) for milling an opening (4) in a casing (3) of a petroleum well (2), and a plug (1) for plugging casing (3) of a petroleum well (2).

13 Claims, 3 Drawing Sheets

METHOD FOR THE FORMATION OF A PLUG IN A PETROLEUM WELL

BACKGROUND OF THE INVENTION

1. Field of the Invention

The present invention relates to a method for the formation of a plug in a petroleum well extending from the earth's surface or the sea floor to a petroleum reservoir, which well is lined with casing. The invention further relates to a tool for milling an opening in a casing of a petroleum well, and a plug for plugging casing of a petroleum well.

2. The Prior Art

Petroleum wells for the exploitation of gas or oil normally consist of an upper and outer conductor, which forms the base of the well, an upper casing located into and in extension of the conductor, and further down in the well more casings which are located into and overlaps the above casing. A production tubing string is located in the middle of the well for transporting petroleum from the bottom of the well to the earth's surface or the sea floor. Annuli are formed between the different casings.

Some wells are test wells which are only used for a shorter period prior to the production from a reservoir, and thus will be plugged after testing. A successful well will normally be temporally plugged before the production starts, while a "dry" well, i.e., a well in which the hydrocarbon content is too small to be worth producing, will be plugged forever. Even the highest producing well will after some time be empty and abandoned, and thus all wells will sooner or later have to be plugged. For this purpose normally concrete plugs are used. In the following concrete plugs are intended to mean plugs constructed of a cement-based material.

Normally two barriers are required between the reservoir and the environment to ensure that there will be no blow-out or leakage of petroleum to the environment. When using concrete plugs, this means that one plug is located in the area of the reservoir. Preferably the second plug should also be located close to the reservoir, but this would mean that the concrete plug would have to be located in the casing, which is fairly smooth and does not provide much anchoring for the concrete plug. The second plug is therefore normally located on top of the well.

In case of permanently abandoned wells, governmental regulations in some areas require that the upper part of the well be removed to a certain depth. For an offshore well this means that the upper part of the well must be milled away to this depth, whereupon a concrete plug is placed in the well. The milling is time-consuming and requires the use of a drilling rig. For an offshore well which shall be abandoned, this means that an offshore platform must be used for several days for plugging a well. The plugging of offshore wells is thus very costly.

Concrete shrinks during curing, which means that cracks, pores and thin annuli between the concrete plug and surrounding walls of the well my be formed. Further, the long-time resistance of concrete to high pressure, high temperature and various chemical substances is uncertain, and thus the use of concrete plugs is linked to a future risk of leakage.

Another problem related to concrete plugs in offshore wells is that the sea floor in some areas sinks due to the exploitation of hydrocarbons. This subsidence causes motion in the ground, which causes stresses in the, concrete plugs, which again contributes to the cracking of the concrete. The subsidence of the sea floor also increases the pressure of the reservoir. Both effects contributes to the risk of leakage through the plugs, which of course is highly undesirable.

Experience supports the above considerations. In fact leakage is a big problem for a large number of wells which have been plugged with concrete plugs.

A further problem with plugging of wells is linked to the production tubing string, which is normally lifted out of the well prior to plugging. The production tubing will after some time get a radioactive scaling, and from an working environmental view it is thus desirable to let the production tubing string stay in the well.

GB 2 275 282 discloses a method for securing a suspended sub-sea well by setting a packer in the casing thereof, the packer having a perforating gun suspended therefrom. The gun is fired to perforate the casing, and then concrete is injected in the annulus behind the casing. The well is then sealed and the casing above the packer can be cut away. As concrete is used as a plug material, this plugging method does not solve the above problems related to concrete plugs.

The object of the invention is to provide a method for the formation of a plug in a petroleum well in which the above problems are reduced or eliminated. A particular object is to provide a method for the formation of a plug which can be carried out without the need for a drilling rig. A further object is to provide a tool and a plug which are favourable in the method. These objects are achieved by a method for the formation of a plug in a petroleum well, a tool for milling an opening in a casing and a plug for plugging casing as mentioned in the introductory part of the description, which method, tool and plug is characterised by the features of the claims. The term "milling" is meant to include both "mechanically or electrically removing" and "hydraulically or electrically activating".

SUMMARY OF THE INVENTION

Thus the invention relates to a method for the formation of a plug in a petroleum well extending from the earth's surface or the sea floor to a petroleum reservoir, which well is lined with a casing. According to the invention, at least one opening is formed in the casing at a distance from the earth's surface. Then a liquid curable resin is provided in at least a portion of the opening and an adjacent area of the well, whereby the resin after curing forms a plug in the well.

Preferably a production tubing string, which normally will be present in the well prior to the formation of the plug, is cut below the area of the plug, and the production tubing string above the cut is lifted out of the well. The production tubing string below the cut is left in the well.

The opening or openings in the casing may be formed by a well perforation tool, forming a plurality of small openings, a water jet tool or a mechanical machining tool. The tool may be supported by a drill pipe string or coil tubing, jointed pipe or wireline. In a preferred embodiment the tool is a milling tool which is suspended from a coil tubing, jointed pipe or wireline, and which is driven by a hydraulic motor which is energised by hydraulic fluid supplied through the coil tubing or the like.

Preferably the opening in the casing is formed in the entire circumference of the casing, and a mechanical packer is set in or right below the opening in the casing, whereupon the liquid resin is placed on top of the packer, the packer thereby forming a basis for the resin plug. In this way a resin plug in which the packer is integrated in the plug is formed. After the resin is cured, a concrete plug may be formed on top of the resin plug. Instead of a mechanical packer also an inflatable packer may be used.

As mentioned above, a well is normally plugged by two plugs. However only one plug or more than one plug may be used, depending on governmental regulations and practise. Typically the invention will be used for an upper plug, while a lower plug is made according to the prior art, but the invention can of course be used for any plug in a well plugged by any number of plugs.

BRIEF DESCRIPTION OF THE DRAWINGS

The invention will now be described by some embodiments with reference to the enclosed drawings, in which.

DETAILED DESCRIPTION OF THE PREFERRED EMBODIMENTS

Figure 1:
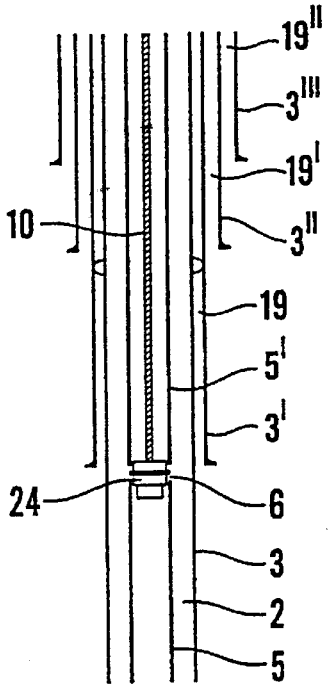
FIGS. 1–5 illustrate a preferred embodiment of the method according to the invention.

FIG. 1 illustrates a petroleum well 2 extending from the earth's surface or the sea floor to a petroleum reservoir for the exploitation of hydrocarbons, i.e., gas, condensate or oil. In FIG. 1, as well as in all the other figures, it shall be understood that the earth's surface is located at a distance above, and the reservoir is located at a distance below the figures. For a reason which is irrelevant to the invention, but which is discussed in the general part of the description, the well 2 shall be plugged.

The well 2 is lined with a casing. Casing 3 is the lower and inner casing, which is overlapped by a casing 3' located above and outside casing 3. Casing 3' is again overlapped by a casing 3 ", etc., all the casings thereby forming a lining of the well. Annuli 19, 19' etc., are correspondingly formed between the casings.

A production tubing string 5, 5' for the hydrocarbons is present in the well. The production tubing string 5, 5' is first cut at a location 6 by a cutting tool 24. The cutting tool is suspended from a drill pipe string 10, which supports and transfers rotational motion to the cutting tool. The cut 6 is placed below the area in which the plug shall be formed. The production tubing string 5' above the cut 6 is lifted out of the well 2 by a suitable tool which may be connected to the drill pipe string or coil tubing.

Figure 2:
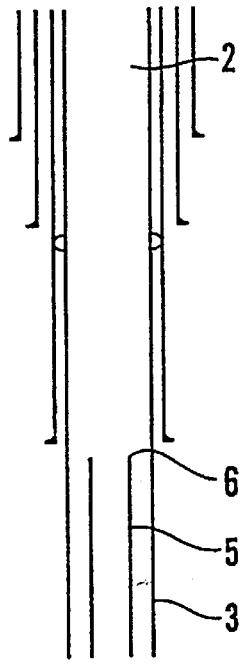

FIG. 2 illustrates the well 2 after the removal of the production tubing string 5', leaving the production tubing string 5 below the cut 6 left in the well 2.

Figure 3:
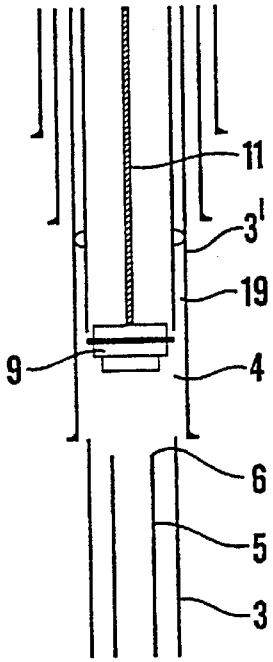

In FIG. 3 a mechanical machining tool 9 has been hoisted down in the well by a coil tubing 11, possibly a jointed pipe or wireline. The machining tool 9 machines at least one opening 4 in the casing 3. In the illustrated embodiment the opening 4 is formed in the entire circumference of the casing 3, and extends over a distance in the longitudinal direction of the well 2. This is achieved by lowering the machining tool down to the cut 6, whereupon the machining of the opening 4 is started during rotation of the tool. When the casing 3 has been penetrated by the machining tool, which can be detected by a suitable detector, the coil tubing 11 is pulled during continuous operation of the machining tool 9, thereby forcing the machining tool upwards, until the desired length or height of the opening 4 is achieved.

Figure 4:
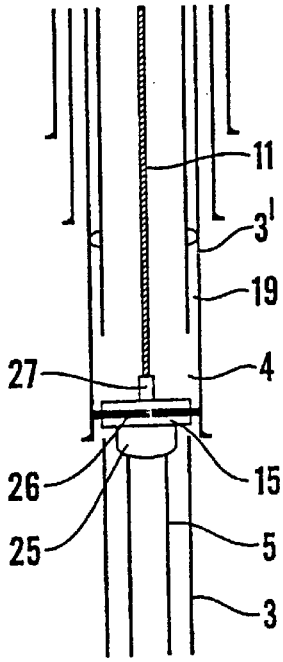

In FIG. 4 the opening 4 is completed and the mechanical machining tool 9 has been removed, i.e, it has been lifted out by the coil tubing. A mechanical packer 15 has been hoisted down into the well by the coil tubing 11. Also an inflatable packer may be used. An anchoring section 25 of the mechanical packer 15 abuts the cut 6 and is anchored to the production tubing string 5, while an expandable seal 26 has been set and expanded in the opening 4 and seals the well. The mechanical packer 15 may be one of various types commercially available. A connector 27 connects the mechanical packer 15 to the coil tubing 11, and allows disconnection of the mechanical packer by a suitable means, e.g., a electromechanical remote controlled mechanism.

Figure 5:
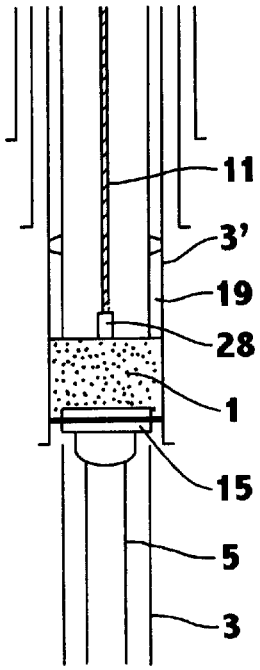

In FIG. 5 the coil tubing 11 has been disconnected from the mechanical packer 15. The coil tubing has been raised to the earth's surface, and a resin nozzle 28 has been connected to the end of the coil tubing, before the coil tubing again has been lowered into the well. A liquid curable resin is now supplied to the area of the opening 4 from the nozzle 28. The amount of resin is adapted to the size of the opening 4, to fill at least a portion of the opening and an adjacent area of the well, the "adjacent area of the well" being understood as the well between the sides of the opening. In the illustrated embodiment the amount of resin is adapted to fill the complete opening and the adjacent area of the well. After curing, the resin forms a plug 1 in the well. Various types of curable resins may be used, which will be discussed later.

Figure 6:
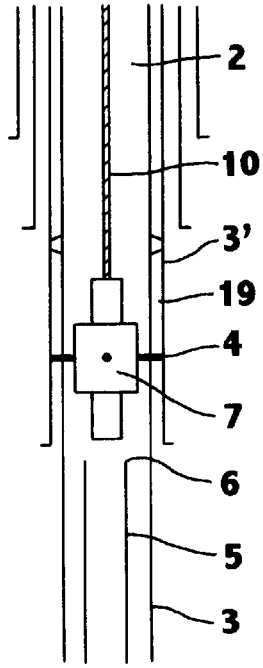
FIGS. 6–8 illustrate an alternative embodiment of the method according to the invention.

FIG. 6 corresponds to FIG. 3, and illustrates another embodiment of the method according to the invention. Instead of a mechanical machining tool, as in FIG. 3, a well perforation tool 7 has been lowered down into the well, close to the cut 6 forming the top of the remaining production tubing string 5. Guns of the well perforation tool 7 are fired, thereby forming a plurality of small openings 4. The tool is supported by a drill pipe 10, however coil tubing could have been used.

Figure 7:
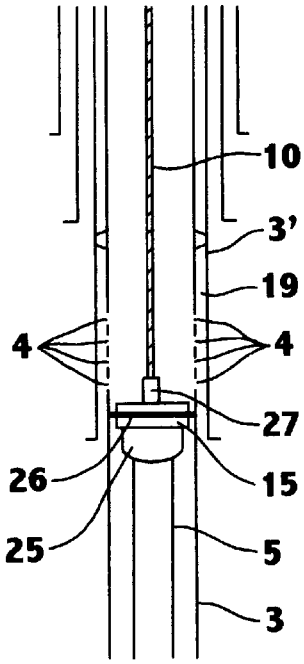

FIG. 7 illustrates the area of the openings 4 after removal of the well perforation tool and introduction of a mechanical packer 15. Like the mechanical packer in FIG. 4, an anchoring section 25 of the mechanical packer 15 is anchored to the production tubing string 5. A releasable connector 27 connects the mechanical packer 15 to a drill pipe 10, however, as for the well perforation tool, coil tubing could have been used. An expandable seal 26 has been set and expanded right below the openings 4 in the casing 3, and thus seals the well.

Figure 8:
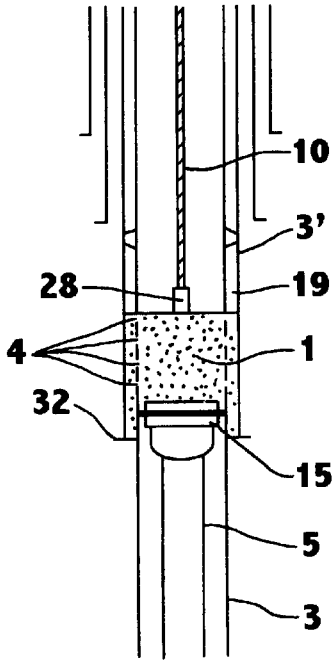

FIG. 8 corresponds to FIG. 5. The mechanical packer 15 has been released, and resin is filled into the area of the openings 4 from a resin nozzle 28 in the end of the drill pipe 10. Again coil tubing could have been used instead of the drill pipe. The resin flows through the openings 4, and fills the annulus 19 outside the casing 3. The openings 4 are located slightly above the foot 32, i.e. the lower end, of the casing 3', in which the annulus 19 stops, and consequently the resin flows down to the foot 32. After curing, the resin forms a plug 1 in the well.

In the above the various tools have been described as being supported by the drill pipe or coil tubing. When supporting a tool by a drill pipe both support and rotational motion can be provided by the drill pipe, with no need for any anchoring of the drill pipe in the well. Additionally fluids can be supplied to the plug area through the drill pipe. The use of a drill pipe is a conventional an advantageous way of operating tools in a well. The drawback is however that a drilling rig is needed for running the drill pipe.

Offshore this means that a drilling platform is required to operate the tools, which is very costly.

When using coil tubing as a support for a tool, fluids can be supplied through the coil tubing, as for the drill pipe. Rotational motion can however not be provided by the rotation of the coil tubing, as the coil tubing is too thin to withstand the required torque. According to the invention there is provided a milling tool in which this problem is solved by providing rotational motion from a hydraulic motor which is energised by hydraulic fluid supplied through the coil tubing, jointed pipe or wireline. The hydraulic motor may be anchored to the casing by mechanical anchors. This principle of providing rotational motion may also be used in the cutting tool for cutting the production tubing string, and thus the complete plugging of the well may be carried out without the use of a drill pipe string. The drilling rig can thus be dispensed with. Offshore this means that the plugging can be done by a ship, which is much less expensive than a drilling platform. The invention thus offers a substantial economical benefit.

The cutting of the production tubing string prior to the formation of the plug is preferred, however not required. An alternative is to remove the complete production tubing string prior to the formation of the plug, and anchor the mechanical packer 15 to the casing right below the area of the plug by mechanical anchors. The production tubing string will however after some use get a radioactive scaling from minerals present in the well, and thus from an working environmental point of view it is preferred that as much as possible of the production tubing string is left in the well. By a modification of the method according to the invention it would in fact be possible to leave the total production tubing string in the well, and provide the plug around the production tubing string.

Figure 9:
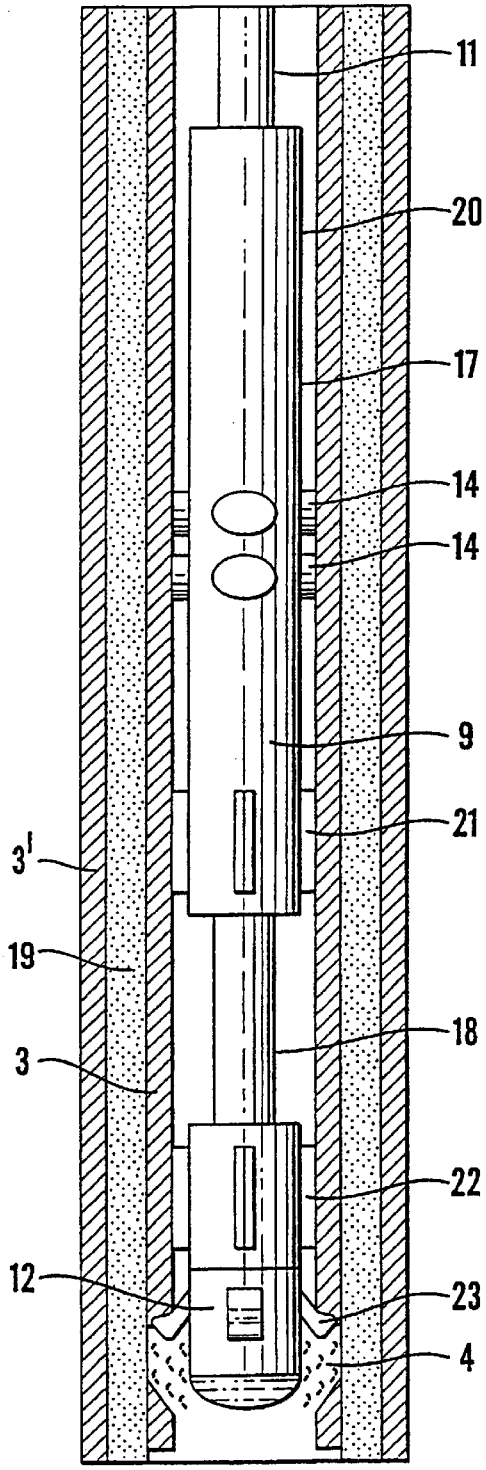
FIG. 9 illustrates a tool according to the invention.

FIG. 9 illustrates a tool 9 according to the invention for milling the opening 4 in the casing 3.

The tool 9 is suspended in the well from coil tubing 11 via a connector 20, which also transfers hydraulic pressurised fluid from the coil tubing 11 to the tool. A stationary housing 17 is anchored to the casing 3 by retractable and remote controlled anchors 14. The remote control of the anchors may be achieved by electromechanical mechanisms which are controlled via electric cabling located in the coil tubing 11. Housing centralisers 21 ensures that the housing 17 is located in the centre of the casing 3.

A shaft 18 extends from the housing 17 to a hydraulic motor 22. The shaft is rotationally secured to both the housing 17 and the stationary part of the hydraulic motor, i.e. the stationary part of the hydraulic motor is prevented from rotating by the anchors 14. Further the shaft 18 is slideably fixed to the housing 17 in the longitudinal direction of the well. For this purpose the upper external portion of the shaft and a corresponding portion of the housing may be provided with splines.

The hydraulic motor 22 is energised by pressurised hydraulic fluid supplied from the coil tubing 11 through the shaft. The rotating part of the hydraulic motor is secured to a milling tool 12, which is provided with cutting blades 23 for milling the opening 4 in the casing 3.

Further the tool 9 comprises a transfer mechanism for transferring motion in the longitudinal direction of the well between the coil tubing 11 and the milling tool 12, for forcing the milling tool 12 upwards in the well 2 by pulling the coil tubing 11. This mechanism may consist of a swivel which links the coil tubing 11 to the shaft 18 in the housing 17.

Neither the splines, the stationary and rotating part of the hydraulic motor nor the swivel are illustrated in FIG. 9, as such components are well-known in the art.

It will be obvious to a person skilled in the art that modifications can be done to the tool according to the invention, e.g. locating the hydraulic motor in the housing 17 and transferring the rotary motion to the milling tool by the shaft 18. Such and other variations may be carried out as long as the essential features, namely that the stationary part of the hydraulic motor is rotationally secured by the anchors, and that the milling tool is movable upwards in the well by pulling the coil tubing, are maintained.

Another possibility may be that the milling tool is not drawn, but that the tool itself is generating an upwardly directed force providing the ring room.

Figure 10:
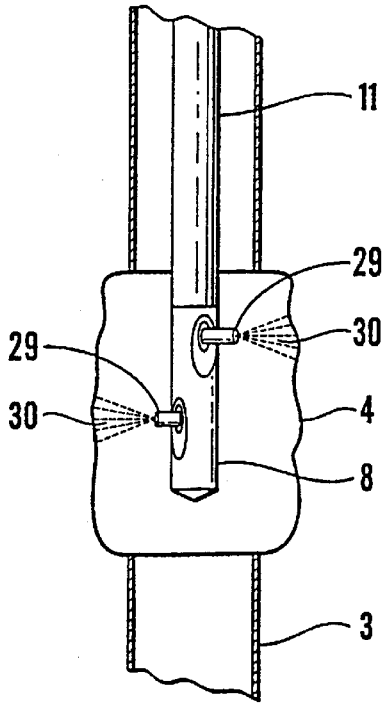
FIG. 10 illustrates a tool to be used in a further embodiment of the method according to the invention.

FIG. 10 illustrates an alternative way of creating the opening 4, namely by a water jet tool 8 which is suspended from coil tubing 11. During use pressurised water containing abrasive particles is supplied through the coil tubing, and sprayed out as water jets 30 through water jet nozzles 29. The water jets 30 abrades the casing 3, and after some time one or more openings 4 are created, depending on the location of the nozzles and whether the water jet tool is rotated during use.

With reference to FIGS. 1–8, the curable resin is provided in the area of the opening 4 by a nozzle 28 in the end of the coil tubing. The resin may also be introduced in the area of the opening 4 by more sophisticated methods which are within the invention.

In one preferred method the liquid curable resin is provided by the following steps:

- forming a train of at least two fluid slugs in the well 2, one of the slugs being a liquid resin slug,
- circulating the train of fluid slugs from the earth's surface, down into the well 2, through the opening 4 in the casing 3 and through an annulus 19 on the outside of the casing 3, back to the earth's surface, and
- stopping the circulation when the liquid resin slug is located in the area of the opening 4.

In another preferred method the liquid curable resin is provided by the following steps:

- forming a train of at least two fluid slugs in coil tubing extending from the earth's surface to the area of the opening 4 in the casing 3, one of the slugs being a liquid resin slug,
- pumping the train of fluid slugs from the earth's surface to the area of the opening 4, and
- stopping the pumping when the liquid resin slug is located in the area of the opening 4.

For both these methods the liquid resin slug may be isolated from the other fluid slugs by pistons or rubber plugs.

Figure 11:
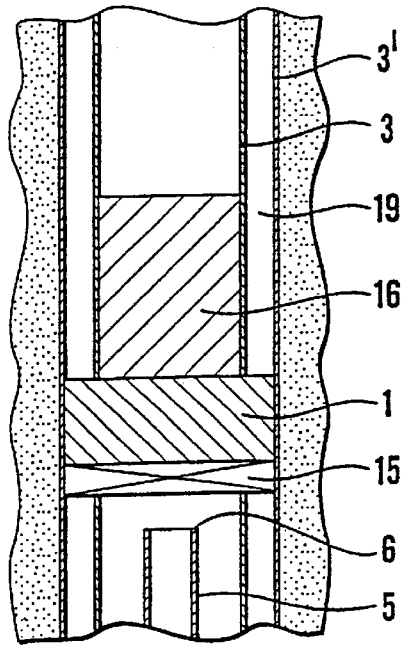
FIG. 11 illustrates a plug according to the invention.

FIG. 11 illustrates a plug 1 according to the invention, comprising a cured resin. The sides of the well, i.e. the casing 3', and the mechanical packer 15 located below the resin formed a mould for the plug prior to curing, and during the curing of the resin the mechanical packer 15 then became an integrated part of the plug. A favourable plug, comprising a first mechanical barrier and a second resin barrier is thereby formed. It can be seen that the diameter of the plug 1 is larger than the internal diameter of the casing 3, which is favourable with respect to possible leakage on the outside of the plug.

FIG. 11 also illustrates a concrete plug 16 which has been formed on top of the resin plug 1 after the curing of the resin, which concrete plug further contributes to the integrity of the plug.

The curable resin may be a thermosetting resin, i.e. a resin that cures when the temperature exceeds a certain level. The resin may also be a chemically curable resin, in which curing takes place after a certain predictable time from adding a curing agent.

Examples of resins are resins selected from the group comprising epoxy resins, phenolic resins and poly-acrylate resins. The resins do not include any aggregates, as concrete. Further the resins do not shrink during curing. The resistance to heat and various chemicals are also good, and both tensile strength and compressive stress is higher than for concrete. The resins form a homogenous plug with no or little tendency to formation of pores and cracks, and with a long durability in hydrocarbon wells.

A suitable resin is the "Therma-Set Resin 2500" available from WeCem in Stavanger, Norway.

The above description is for illustrative purposes only, and all variants which are within the scope of the claims shall be included in the patent protection.

What is claimed is:

1. A method for the formation of a plug (1) in a petroleum well (2) extending from the earth's surface or the sea floor to a petroleum reservoir, which well is lined with casing (3, 3'), comprising the following steps:

a) forming at least one opening (4) in the casing (3) at a distance from the earth's surface, b) providing a liquid curable resin in at least a portion of the opening (4) and an adjacent area of the well (2), which material after curing forms a plug (1) in the well, wherein in step a) the opening (4) is formed by a milling tool (12) which is driven by a hydraulic motor (22) which is energised by hydraulic fluid supplied through coil tubing, jointed pipe or wireline (11), and which is anchored to the casing (3) by mechanical anchors (14), and in step b) the material which is provided in at least a portion the opening is a liquid curable resin.

2. A method according to claim 1, wherein a production tubing string (5, 5') which is present in the well (2) prior to the formation of the plug (1) is cut (6) below an area of the plug (1), and the production tubing string (5') above the cut (6) is lifted out of the well (2) while the production tubing string (5) below the cut (6) is left in the well (2).

3. A method according to claim 1 or 2, wherein the milling tool (12) is suspended from coil tubing, jointed pipe or wireline (11).

4. A method according to claim 3, wherein the opening (4) in the casing (3) is formed over a distance in a longitudinal direction of the well (2) by pulling the coil tubing (11) during operation of the milling tool (12).

5. A method according to claims 1 or 2, wherein the opening (4) in the casing (3) is formed in an entire circumference of the casing (3).

6. A method according to claims 1 or 2, wherein a mechanical or inflatable packer (15) is set right below an area of the opening (4) in the casing (3).

7. A method according to claims 1 or 2, wherein after step a) and prior to step b) a mechanical packer (15) is set in the opening (4) in the casing (3).

8. A method according to claims 1 or 2, wherein is carried out by:

forming a train of at least two fluid slugs in the well (2), one of the slugs being a liquid resin slug, circulating the train of fluid slugs from the earth's surface, down into the well(2), through the opening (4) in the casing (3) and through an annulus (19) on the outside of the casing (3), back to the earth's surface, and stopping the circulation when the liquid resin slug is located in the area of the opening (4).

9. A method according to claims 1 or 2, wherein step b) is carried out by:

forming a train of at least two fluid slugs in coil tubing extending from the earth's surface to the area of the opening (4) in the casing (3), one of the slugs being a liquid resin slug, pumping the train of fluid slugs from the earth's surface to the area of the opening (4), and stopping the pumping when the liquid resin slug is located in the area of the opening (4).

10. A method according to claim 9, including isolating the liquid resin slug from the other fluid slugs by pistons or rubber plugs.

11. A method according to claims 1 or 2, wherein after the curing of the resin plug (1) a concrete plug (16) is formed on top of the resin plug (1).

12. A tool (9) for milling an opening (4) in a casing (3) of a petroleum well (2), which opening will at least partly be filled with a curable resin for the formation of a plug, by comprising:

a stationary housing (17) which is anchored to the casing (3) by anchors (14) and suspended in the well (2) from coil tubing, jointed pipe or wireline (11), a hydraulic motor (22) for creating rotary motion, energised by pressurised hydraulic fluid supplied from the coil tubing, jointed pipe or wireline (11), the stationary part of the hydraulic motor (22) being rotationally secured to the housing (17), a milling tool (12) for milling the opening (4) in the casing (3), the milling tool (12) being rotationally secured to the rotating part of the hydraulic motor (22) and slideable in the longitudinal direction of the Well relative to the housing (17), a transfer mechanism for transferring motion in the longitudinal direction of the well between the coil tubing, jointed pipe or wireline (11) and the milling tool (12), for forcing the milling tool (12) upwards in the well (2) by pulling the coil tubing (11).

13. A plug (1) located in a casing (3) of a petroleum well (2), consisting of a mechanical or inflatable packer (15) and a cured resin thereabove, the mechanical or inflatable packer (15) being integrated with the cured resin thereabove by the curing of the resin.

* * * * *

UNITED STATES PATENT AND TRADEMARK OFFICE

CERTIFICATE OF CORRECTION

PATENT NO. : 6,478,088 B1 
DATED : November 12, 2002
INVENTOR(S) : Henning Hansen and Svein Henning Solversen It is certified that error appears in the above-identified patent and that said Letters Patent is hereby corrected as shown below:

Title page,
Item [22], should read

-- [22] PCT Filed: May 4, 1999 --

Signed and Sealed this

First Day of April, 2003

JAMES E. ROGAN
*Director of the United States Patent and Trademark Office*